US012674600B2

(12) United States Patent
Miura et al.

(10) Patent No.: US 12,674,600 B2
(45) Date of Patent: Jul. 7, 2026

(54) INDOOR UNIT, AND AIR CONDITIONER

(71) Applicant: DAIKIN INDUSTRIES, LTD., Osaka (JP)

(72) Inventors: Shu Miura, Osaka (JP); Keisuke Nishitani, Osaka (JP); Tsunehisa Sanagi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 217 days.

(21) Appl. No.: 18/387,282

(22) Filed: Nov. 6, 2023

(65) Prior Publication Data

US 2024/0068706 A1 Feb. 29, 2024

Related U.S. Application Data

(63) Continuation of application No. PCT/JP2022/019569, filed on May 6, 2022.

(30) Foreign Application Priority Data

May 7, 2021 (JP) ..... 2021-079371
May 7, 2021 (JP) ..... 2021-079372

(51) Int. Cl.
*F24F 13/22* (2006.01)

(52) U.S. Cl.
CPC ..... *F24F 13/222* (2013.01)

(58) Field of Classification Search
CPC ..... F24F 13/22; F24F 13/222
See application file for complete search history.

(56) References Cited

U.S. PATENT DOCUMENTS

2021/0389015 A1 12/2021 Kitagawa et al.

FOREIGN PATENT DOCUMENTS

CN 109269069 A 1/2019
CN 109558230 A 4/2019
JP 52-141034 A 11/1977
(Continued)

OTHER PUBLICATIONS

JP 2008-232511 (English translation) (Year: 2008).*
(Continued)

*Primary Examiner* — Jonathan Bradford
(74) *Attorney, Agent, or Firm* — Birch, Stewart, Kolasch & Birch, LLP

(57) ABSTRACT

An indoor unit is used in an air conditioner capable of executing a cooling operation by circulating a refrigerant. The indoor unit includes an indoor heat exchanger, a drain pan, a drain pump, and an indoor controller. The indoor heat exchanger (50) exchanges heat between the refrigerant and indoor air. The drain pan receives water generated in the indoor heat exchanger. The drain pump sucks up the water from the drain pan. At a time of executing the cooling operation, the indoor controller operates the drain pump when an evaporation temperature of the refrigerant in the indoor heat exchanger is equal to or lower than a dew point temperature of the indoor air. At the time of executing the cooling operation, the indoor controller controls the drain pump so as to have a period in which operation of the drain pump is not performed when the evaporation temperature of the refrigerant is higher than the dew point temperature.

5 Claims, 9 Drawing Sheets

(56) References Cited

FOREIGN PATENT DOCUMENTS

| | | | |
|---|---|---|---|
| JP | 63-302241 | A | 12/1988 |
| JP | 4-93545 | A | 3/1992 |
| JP | 7-332743 | A | 12/1995 |
| JP | 3459467 | B2 | 10/2003 |
| JP | 2008-232511 | A | 10/2008 |
| JP | 2009-180492 | A | 8/2009 |
| JP | 6721060 | B2 | 7/2020 |
| JP | 2020-133915 | A | 8/2020 |
| JP | 2020-139673 | A | 9/2020 |

OTHER PUBLICATIONS

International Preliminary Report on Patentability and English translation of the Written Opinion of the International Searching Authority for International Application No. PCT/JP2022/019569, dated Nov. 16, 2023.
Extended European Search Report for European Application No. 22798963.9, dated Oct. 10, 2024.
International Search Report for PCT/JP2022/019569 mailed on Jul. 19, 2022.

* cited by examiner

INDOOR UNIT, AND AIR CONDITIONER

CROSS REFERENCE TO RELATED APPLICATIONS

This application is a Continuation of PCT International Application No. PCT/JP2022/019569, filed on May 6, 2022, which claims priority under 35 U.S.C. § 119(a) to Patent Application Nos. JP 2021-079371 and JP 2021-079372, both filed in Japan on May 7, 2021, all of which are hereby expressly incorporated by reference into the present application.

TECHNICAL FIELD

The present disclosure relates to an indoor unit, and an air conditioner.

BACKGROUND ART

An air conditioner disclosed in Patent Literature 1 (JP H07-332743 A) includes a mechanism in which drain water generated in an evaporator is received into a drain pan, and the drain water in the drain pan is discharged using a drain pump. The air conditioner starts operation of the drain pump when a water level of the drain water in the drain pan becomes equal to or higher than a height of a water suction port of the drain pump, and stops the operation of the drain pump when the water level of the drain water becomes equal to or lower than the height of the water suction port of the drain pump.

SUMMARY

An indoor unit according to a first aspect is used in an air conditioner capable of executing a cooling operation by circulating a refrigerant. The indoor unit includes a heat exchanger, a drain pan, a drain pump, and a control unit. The heat exchanger exchanges heat between the refrigerant and indoor air. The drain pan receives water generated in the heat exchanger. The drain pump sucks up the water from the drain pan. The control unit performs a first control at a time of executing the cooling operation. In the first control, the control unit operates the drain pump when an evaporation temperature of the refrigerant in the heat exchanger is equal to or lower than a dew point temperature of the indoor air. In the first control, the control unit controls the drain pump so as to have a period in which operation of the drain pump is not performed when the evaporation temperature is higher than the dew point temperature.

DESCRIPTION OF EMBODIMENTS

First Embodiment

An air conditioner 10 that includes an indoor unit 12 according to a first embodiment of the present disclosure will be described with reference to the drawings.

(1) Overall Configuration of Air Conditioner 10

Figure 1:
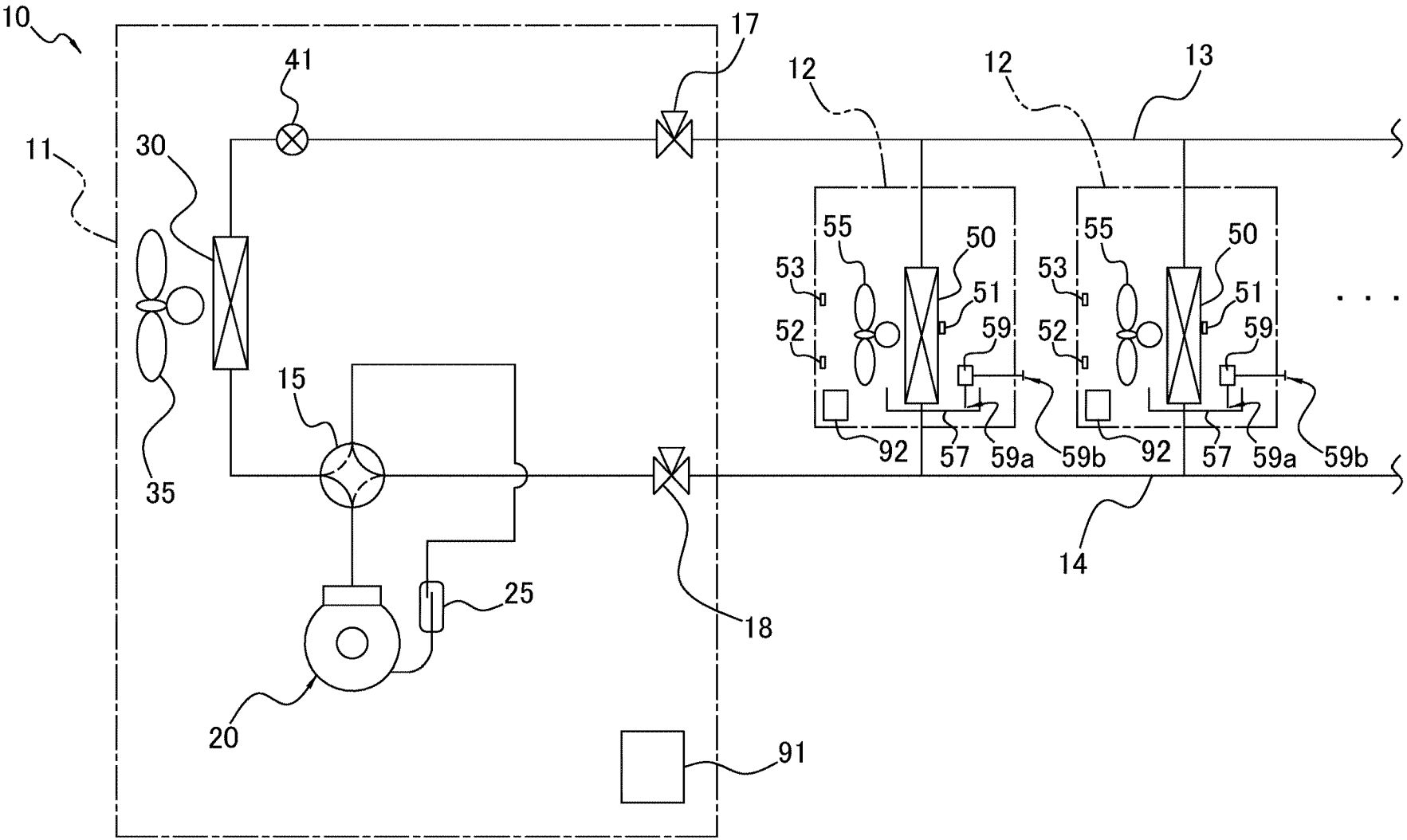
FIG. 1 is a diagram illustrating a refrigerant circuit of an air conditioner 10 including an indoor unit 12.

As illustrated in FIG. 1, the air conditioner 10 is a refrigerant pipe-scheme air conditioner, and heats and cools each room in a building by executing a vapor compression refrigeration cycle operation. The air conditioner 10 includes an outdoor unit 11, an indoor unit 12, a liquid-refrigerant connection pipe 13, and a gas-refrigerant connection pipe 14. The outdoor unit 11 and the indoor unit 12 are connected via the liquid-refrigerant connection pipe 13 and the gas-refrigerant connection pipe 14. This configures a refrigerant circuit of the air conditioner 10. In the refrigerant circuit of the air conditioner 10, a refrigerant sealed in the refrigerant circuit circulates. The air conditioner 10 performs a refrigeration cycle operation in which the refrigerant is compressed, radiates heat (condensed), decompressed, absorbs heat (evaporated), and then compressed again in the refrigerant circuit.

The outdoor unit 11 is disposed outside the building, in a basement of the building, or the like. The outdoor unit 11 mainly includes a compressor 20, a four-way switching valve 15, an outdoor heat exchanger 30, an outdoor expansion valve 41, an outdoor fan 35, a liquid-side shutoff valve 17, a gas-side shutoff valve 18, an accumulator 25, and an outdoor control unit 91.

Figure 2:
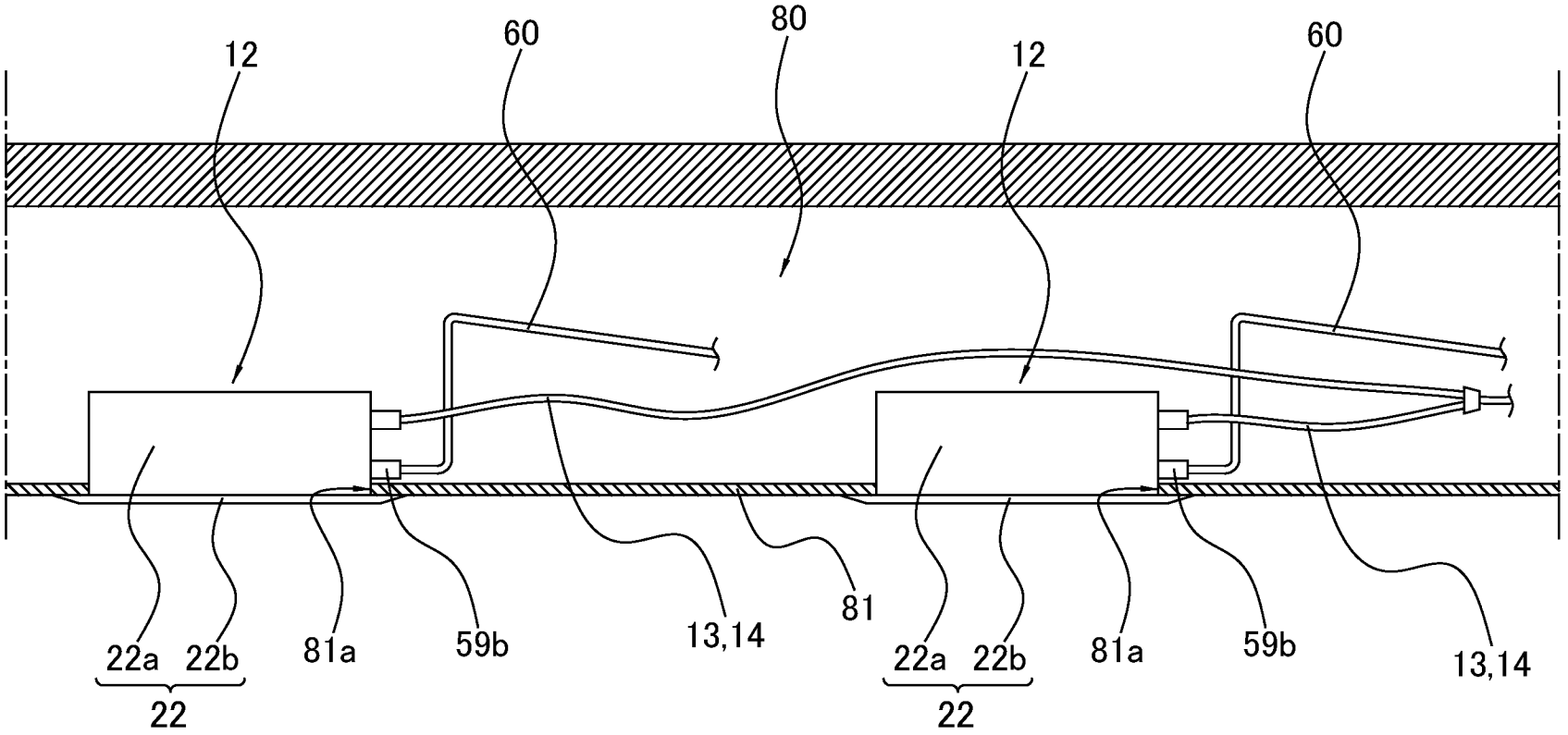
FIG. 2 is a schematic view of the indoor unit 12 installed in a ceiling space 80.

As illustrated in FIG. 2, the indoor unit 12 is installed in a ceiling space 80 located above a ceiling 81 of each room. The indoor unit 12 is an indoor unit of a type to be installed by being built in the ceiling 81. The indoor unit 12 mainly includes a casing 22, a wind direction changing member 39, an indoor heat exchanger 50, an indoor fan 55, a bell mouth 56, a drain pan 57, a drain pump 59, and an indoor control unit 92. The air conditioner 10 has a decentralized configuration in which the plurality of indoor units 12 are connected to one outdoor unit 11. However, for example, the air conditioner 10 may have a configuration in which one indoor unit 12 is connected to one outdoor unit 11.

One end of the indoor heat exchanger 50 is connected to the liquid-refrigerant connection pipe 13, and the other end thereof is connected to the gas-refrigerant connection pipe 14. The indoor heat exchanger 50 functions as a heat absorber (evaporator) or a radiator (condenser) for the refrigerant. When the air conditioner 10 is performing a cooling operation, the indoor heat exchanger 50 functions as the heat absorber. When the air conditioner 10 is performing a heating operation, the indoor heat exchanger 50 functions as the radiator.

The outdoor control unit 91 is a computer that controls components of the outdoor unit 11. The indoor control unit 92 is a computer that controls components of the indoor unit 12. Each of the outdoor control unit 91 and the indoor control unit 92 mainly includes an arithmetic device and a storage device. The arithmetic device is, for example, a CPU or a GPU. The arithmetic device reads a program stored in the storage device and performs predetermined arithmetic processing in accordance with the program. The arithmetic device writes a result of the arithmetic processing in the storage device and reads information stored in the storage device in accordance with the program. The outdoor control unit 91 is connected to the indoor control unit 92 via a communication line to transmit and receive data, a control signal, and the like.

The liquid-refrigerant connection pipe 13 and the gas-refrigerant connection pipe 14 are refrigerant pipes laid on site when the outdoor unit 11 and the indoor unit 12 are installed in the building. As illustrated in FIG. 2, the liquid-refrigerant connection pipe 13 and the gas-refrigerant connection pipe 14 pass through the ceiling space 80.

(2) Configuration of Indoor Unit 12

(2-1) Casing 22

Inside the casing 22 are mainly provided the indoor heat exchanger 50, the indoor fan 55, the bell mouth 56, the drain pan 57, the drain pump 59, and the indoor control unit 92. The casing 22 mainly includes a casing main body 22*a* and a face panel 22*b*.

As illustrated in FIG. 2, the casing main body 22*a* is disposed so as to be inserted into an opening 81*a* formed in the ceiling 81 of each room. The casing main body 22*a* is a substantially octagonal box-shaped body in which long sides and short sides are alternately formed in a planar view, and a lower surface thereof is opened. The casing main body 22*a* has a top panel, and a plurality of side plates extending downward from a peripheral edge of the top panel.

The face panel 22*b* is disposed so as to be fitted into the opening 81*a* of the ceiling 81. The face panel 22*b* extends further to an outside than the top panel and the side plates of the casing main body 22*a* in the planar view, and is attached to a lower part of the casing main body 22*a* from an indoor side.

Figure 3:
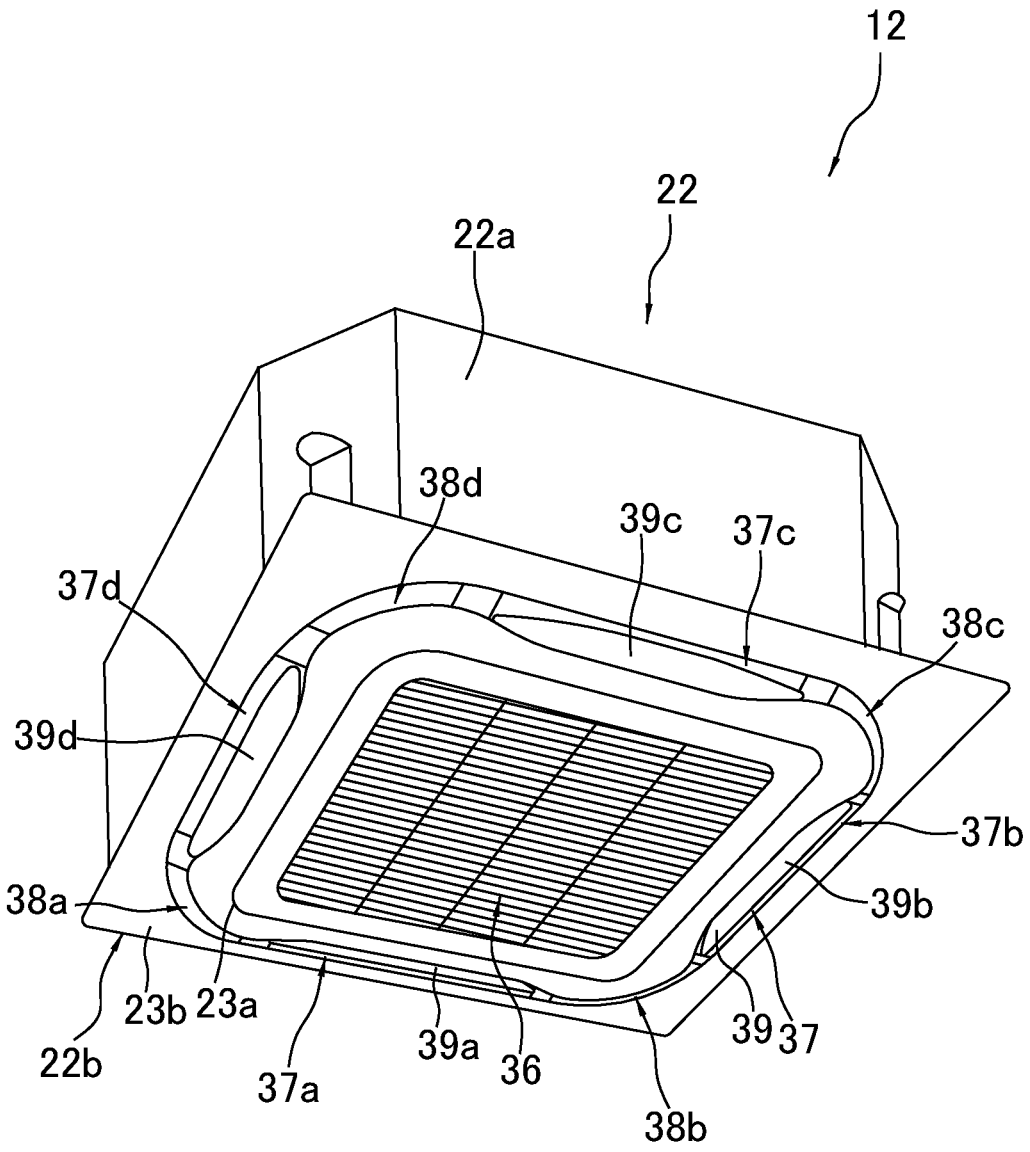
FIG. 3 is a perspective view of the indoor unit 12.
Figure 4:
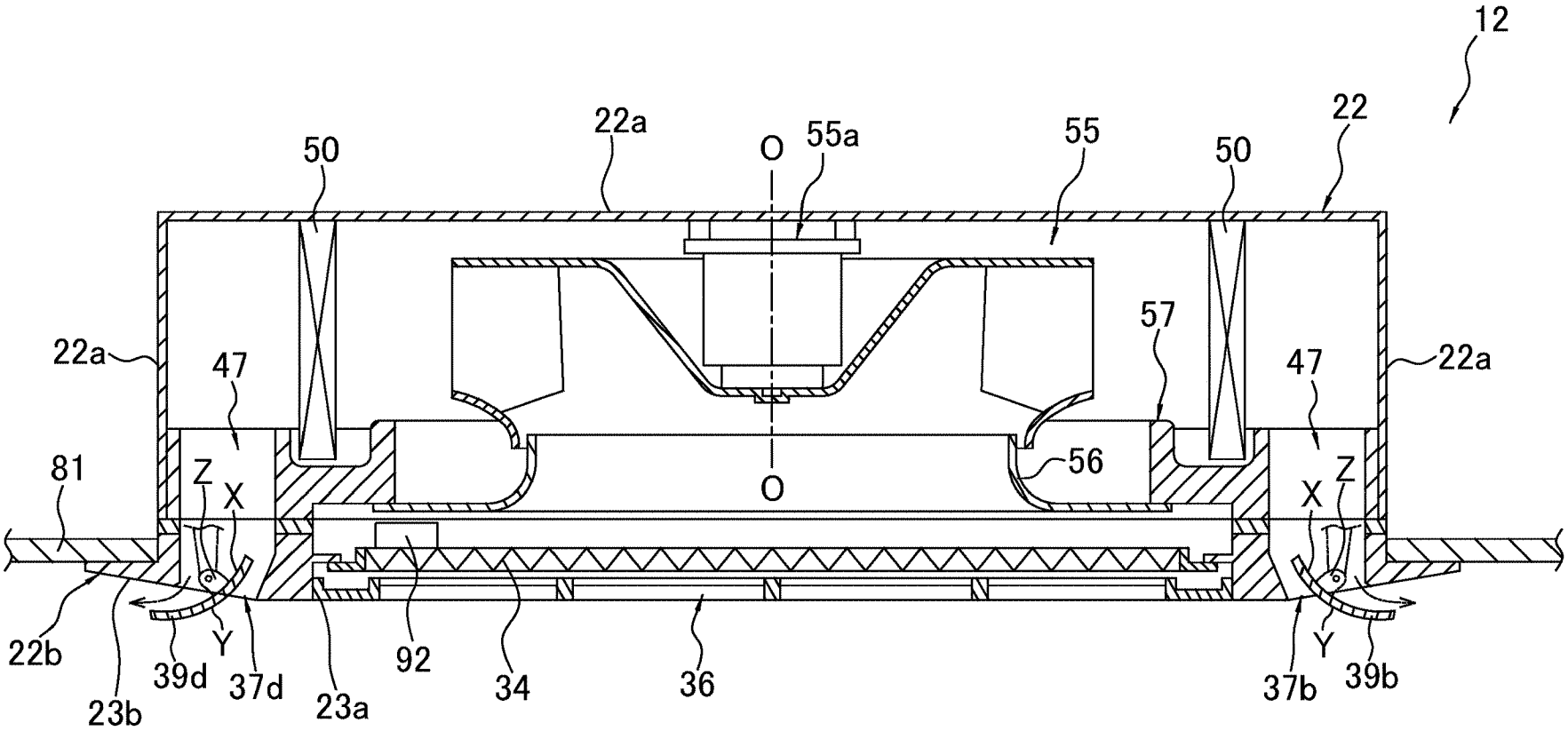
FIG. 4 is a cross-sectional view of the indoor unit 12.

As illustrated in FIG. 3, the face panel 22*b* includes an inner frame 23*a* and an outer frame 23*b* provided outside the inner frame 23*a* in the planar view. Inside the inner frame 23*a* in the planar view is formed a suction port 36 having a substantially quadrangular shape in the planar view opened downward. Inside the outer frame 23*b* and outside the inner frame 23*a* in the planar view are formed a blow-out port 37 opened in a range from a downward direction to a diagonally downward direction and a corner blow-out port 38. As illustrated in FIG. 4, a filter 34 is provided above the suction port 36 to remove dust from air sucked through the suction port 36. The blow-out port 37 includes a first blow-out port 37*a*, a second blow-out port 37*b*, a third blow-out port 37*c*, and a fourth blow-out port 37*d*. These blow-out ports are provided between the inner frame 23*a* and the outer frame 23*b* so as to extend in parallel with respective sides of the suction port 36 having a substantially quadrangular shape in the planar view. The corner blow-out port 38 includes a first corner blow-out port 38*a*, a second corner blow-out port 38*b*, a third corner blow-out port 38*c*, and a fourth corner blow-out port 38*d*. These corner blow-out ports are provided at four corners of a place between the inner frame 23*a* and the outer frame 23*b* in the planar view.

The wind direction changing member 39 is attached to a lower surface of the casing main body 22*a*. The wind direction changing member 39 is a member that can change a direction of air flow passing through the blow-out port 37. The wind direction changing member 39 includes a first wind direction changing member 39*a* disposed at the first blow-out port 37*a*, a second wind direction changing member 39*b* disposed at the second blow-out port 37*b*, a third wind direction changing member 39*c* disposed at the third blow-out port 37*c*, and a fourth wind direction changing member 39*d* disposed at the fourth blow-out port 37*d*. Each of the wind direction changing members 39*a* to 39*d* includes a flap main body and an arm Z. The flap main body is a plate-shaped member having a concave surface X having a concave cross-sectional shape perpendicular to a rotational axis, and a convex surface Y on a back side of the concave surface X and having a convex cross-sectional shape perpendicular to the rotational axis. The concave surface X is a surface facing an upstream side of the blow-out port 37 when the air conditioner 10 is stopped, and includes a plurality of knurls extending in a longitudinal direction. The convex surface Y is a surface facing to a lower side, which is an indoor space side, at a time of stopping, and has a smooth face surface. The arm Z is secured to a side of the flap main body provided with the concave surface X. An end of the arm Z opposite to the flap main body is pivotally supported so as to be rotatable via a drive shaft with respect to a structural component extending from an interior of the indoor unit 3. Each of the drive shafts extends along the longitudinal direction of each of the blow-out ports 37*a* to 37*d* in the planar view. The wind direction changing member 39 includes a not-illustrated stepping motor connected to an end of the corresponding drive shaft. The flap main body and the arm Z receive a driving force from the motor to rotate via the drive shaft, thereby changing a wind direction. A posture of the wind direction changing member 39 is controlled so that the wind direction changing member 39 may have a plurality of kinds of predetermined angles determined in advance according to a degree of rotation of the drive shaft. During the cooling operation and the heating operation, air passing through the upstream side of the blow-out port 37 mainly hits the concave surface X of the flap main body.

The respective postures of the first wind direction changing member 39*a*, the second wind direction changing member 39*b*, the third wind direction changing member 39*c*, and the fourth wind direction changing member 39*d* are independently controlled by the indoor control unit 92. When receiving a wind direction instruction from a user via a remote control or the like, the indoor control unit 92 drives the drive shaft to cause the posture of the wind direction changing member 39 to be controlled.

(2-2) Indoor Heat Exchanger 50

The indoor heat exchanger 50 is a heat exchanger that is disposed inside the casing main body 22*a* in a bent state so as to surround the indoor fan 55 in the planar view. More specifically, the indoor heat exchanger 50 includes multiple heat transfer fins arranged at predetermined spaces, and a plurality of heat transfer tubes penetrating the heat transfer fins in a thickness direction. A liquid side of the indoor heat exchanger 50 is connected to an end of the liquid-refrigerant connection pipe 13, and a gas side of the indoor heat exchanger 50 is connected to an end of the gas-refrigerant connection pipe 14.

(2-3) Indoor Fan 55

The indoor fan 55 is a centrifugal fan arranged inside the casing main body 22*a*. The indoor fan 55 forms an air flow where indoor air is sucked into the casing 22 through the suction port 36 of the face panel 22*b*, passes through the indoor heat exchanger 50, and is then blown out of the casing 22 through the blow-out port 37 of the face panel 22*b*. The indoor fan 55 includes a fan motor 55*a* provided at a center of the top panel of the casing main body 22*a* and an impeller connected to the fan motor 55*a* and rotationally driven. The impeller is an impeller having a turbo blade, and can suck air into the impeller from below and blow out the air toward an outer peripheral side of the impeller in the planar view by rotating about a rotational axis O. The number of rotations of the indoor fan 55 is controlled by the indoor control unit 92 to enable air volume to be controlled in a plurality of levels.

(2-4) Drain Pan 57

As illustrated in FIG. 4, the drain pan 57 is disposed below the indoor heat exchanger 50, and receives drain water generated by condensation of moisture contained in air at the indoor heat exchanger 50. The drain pan 57 is attached to a lower portion of the casing main body 22*a*. The drain pan 57 is provided with a cylindrical space extending in an up-down direction inside the indoor heat exchanger 50 in the planar view. On a lower side inside the space, the bell mouth 56 is disposed. The bell mouth 56 is a member for guiding air sucked from the suction port 36 to the indoor fan 55, and has a flat portion extending horizontally and a cylindrical portion extending in the up-down direction around a center.

The drain pan 57 includes a plurality of blow-out channels 47 extending in the up-down direction outside the indoor heat exchanger 50 in the planar view. The blow-out channels 47 have a first blow-out channel communicating with the first blow-out port 37*a* at a lower end of the first blow-out channel, a second blow-out channel communicating with the second blow-out port 37*b* at a lower end of the second blow-out channel, a third blow-out channel communicating with the third blow-out port 37*c* at a lower end of the third blow-out channel, and a fourth blow-out channel communicating with the fourth blow-out port 37*d* at a lower end of the fourth blow-out channel. Also, the blow-out channels 47 have a first corner blow-out channel communicating with the first corner blow-out port 38*a* at a lower end of the first corner blow-out channel, a second corner blow-out channel communicating with the second corner blow-out port 38*b* at a lower end of the second corner blow-out channel, a third corner blow-out channel communicating with the third corner blow-out port 38*c* at a lower end of the third corner blow-out channel, and a fourth corner blow-out channel communicating with the fourth corner blow-out port 38*d* at a lower end of the fourth corner blow-out channel.

When the air conditioner 10 is performing the cooling operation, dew condensation water may be generated on a surface of the indoor heat exchanger 50. The drain pan 57 is provided to receive the dew condensation water falling from the surface of the indoor heat exchanger 50. The dew condensation water falling from the surface of the indoor heat exchanger 50 is stored in the drain pan 57 as drain water.

Figure 5:
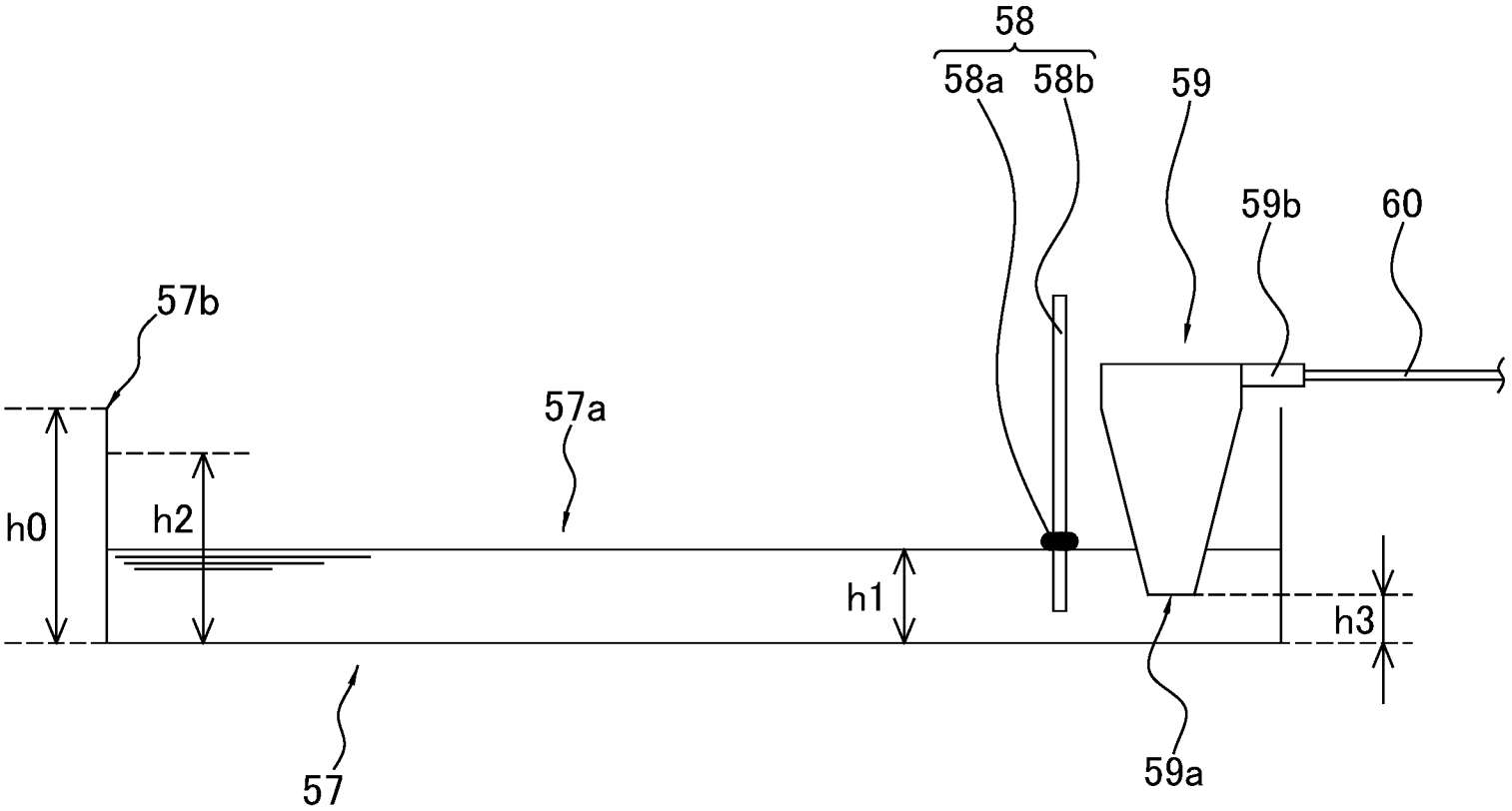
FIG. 5 is a schematic configuration diagram of a drain pan 57 and a drain pump 59.

As illustrated in FIG. 5, the drain pan 57 has a concave portion 57*a* that is a space in which the drain water is stored. A bottom surface of the concave portion 57*a* is disposed so as to be substantially parallel to a horizontal plane. Therefore, a water surface of the drain water in the drain pan 57 is substantially parallel to the horizontal plane. Hereinbelow, a water level means a vertical height position of the water surface of the drain water in the drain pan 57 with reference to the bottom surface of the concave portion 57*a*. When no drain water is stored in the drain pan 57, the water level is 0. The water level when the drain water is stored in the drain pan 57 up to a height position of an upper end 57*b* of the drain pan 57 is a maximum water level h0. When the drain water falls from the indoor heat exchanger 50 into the drain pan 57 with the water level being the maximum water level h0, the drain water leaks from the drain pan 57.

A water level sensor 58 is disposed in the drain pan 57. The water level sensor 58 mainly includes a float 58*a* and a support 58*b*. The float 58*a* is a member that can float on the drain water. The float 58*a* rises or drops according to a change in the water level of the drain pan 57. The support 58*b* supports the float 58*a*. The indoor control unit 92 acquires the water level of the drain pan 57 by detecting a height position of the float 58*a*.

(2-5) Drain Pump 59

The drain pump 59 discharges the drain water from the drain pan 57. The drain pump 59 has a water suction port 59*a* and a water drain port 59*b*. The drain pump 59 sucks the drain water in the drain pan 57 from the water suction port 59*a* and discharges the same from the water drain port 59*b*.

The water suction port 59*a* is located at a tip end of a portion protruding downward from an upper side of the drain pump 59. The water suction port 59*a* is located in the concave portion 57*a* of the drain pan 57. The water suction port 59*a* is located above the bottom surface of the concave portion 57*a* of the drain pan 57 and below the upper end 57*b* of the drain pan 57.

The water drain port 59*b* is a tip opening of a copper pipe protruding from a side plate of the casing 22. As illustrated in FIGS. 2 and 5, a drain pipe 60 is connected to the water drain port 59*b*. The drain pipe 60 is installed in the ceiling space 80. The drain pipe 60 is a pipe for draining the drain water into an outside of the building or a drain ditch of the building.

The drain pump 59 applies pressure to the drain water in the drain pan 57 by driving of a not-illustrated motor, sucks up the drain water from the drain pan 57, and sends the drain water to the drain pipe 60. Accordingly, the drain pump 59 discharges the drain water to the outside of the indoor unit 12. The indoor control unit 92 controls time to start operation of the drain pump 59 and time to stop operation of the drain pump 59.

(3) Operation of Air Conditioner 10

(3-1) Heating Operation

In a case where the air conditioner 10 executes the heating operation, the four-way switching valve 15 is switched to a state illustrated by a broken line in FIG. 1. In the refrigerant circuit of the air conditioner 10, a low-pressure gas refrigerant of the refrigeration cycle is sucked into the compressor 20, and discharged after compressed to a high-pressure refrigerant of the refrigeration cycle. The high-pressure gas refrigerant discharged from the compressor 20 is sent to the indoor heat exchanger 50 via the four-way switching valve 15, the gas-side shutoff valve 18, and the gas-refrigerant connection pipe 14. The high-pressure gas refrigerant sent to the indoor heat exchanger 50 is condensed by heat exchange with indoor air in the indoor heat exchanger 50, and becomes a high-pressure liquid refrigerant. The indoor air is thus heated. The liquid refrigerant that has been condensed in the indoor heat exchanger 50 is sent to the outdoor expansion valve 41 through the liquid-refrigerant connection pipe 13 and the liquid-side shutoff valve 17. The refrigerant sent to the outdoor expansion valve 41 is decompressed by the outdoor expansion valve 41 to low pressure in the refrigeration cycle. The low-pressure refrigerant decompressed in the outdoor expansion valve 41 is sent to the outdoor heat exchanger 30. The low-pressure refrigerant sent to the outdoor heat exchanger 30 is evaporated by heat exchange with outdoor air in the outdoor heat exchanger 30, and becomes a low-pressure gas refrigerant. The low-pressure refrigerant that has been evaporated in the outdoor heat exchanger 30 is sucked again into the compressor 20 via the four-way switching valve 15 and the accumulator 25.

(3-2) Cooling Operation

In a case where the air conditioner 10 executes the cooling operation, the four-way switching valve 15 is switched to a state illustrated by a solid line in FIG. 1. In the refrigerant circuit of the air conditioner 10, a low-pressure gas refrigerant of the refrigeration cycle is sucked into the compressor 20, and discharged after compressed to a high-pressure refrigerant of the refrigeration cycle. The high-pressure gas refrigerant discharged from the compressor 20 is sent to the outdoor heat exchanger 30 through the four-way switching valve 15. The high-pressure gas refrigerant sent to the outdoor heat exchanger 30 is condensed by heat exchange with outdoor air in the outdoor heat exchanger 30, and becomes a high-pressure liquid refrigerant. The liquid refrigerant that has been condensed in the outdoor heat exchanger 30 is decompressed by the outdoor expansion valve 41 to low pressure in the refrigeration cycle. The low-pressure refrigerant decompressed in the outdoor expansion valve 41 is sent to the indoor heat exchanger 50 through the liquid-side shutoff valve 17 and the liquid-refrigerant connection pipe 13. The refrigerant sent to the indoor heat exchanger 50 is evaporated by heat exchange with indoor air in the indoor heat exchanger 50, and becomes a low-pressure gas refrigerant. The indoor air is thus cooled. The gas refrigerant that has been evaporated in the indoor heat exchanger 50 is sucked again into the compressor 20 via the gas-refrigerant connection pipe 14, the gas-side shutoff valve 18, the four-way switching valve 15, and the accumulator 25.

(4) Control of Indoor Unit 12

The indoor control unit 92 performs a first control at a time of executing the cooling operation of the air conditioner 10. In the first control, the indoor control unit 92 operates the drain pump 59 when the first condition that an evaporation temperature of the refrigerant in the indoor heat exchanger 50 is equal to or lower than a dew point temperature of the indoor air is satisfied. In the first control, the indoor control unit 92 controls the drain pump 59 so as to have a period in which operation of the drain pump 59 is not performed when a second condition that the evaporation temperature of the refrigerant in the indoor heat exchanger 50 is higher than the dew point temperature of the indoor air is satisfied.

In a case where the evaporation temperature of the refrigerant is higher than the dew point temperature, water vapor contained in the indoor air is hardly condensed on a surface of the indoor heat exchanger 50. In a case where the evaporation temperature of the refrigerant is equal to or lower than the dew point temperature, the water vapor contained in the indoor air is easily condensed on the surface of the indoor heat exchanger 50. Therefore, when the second condition is satisfied, the amount of the dew condensation water generated on the surface of the indoor heat exchanger 50 is smaller than that when the first condition is satisfied. Accordingly, when the second condition is satisfied, a speed at which the water level of the drain water in the drain pan 57 rises is lower than when the first condition is satisfied.

When the first condition is satisfied, the indoor control unit 92 starts the operation of the drain pump 59 in a case where the drain pump 59 is stopped, and continues the operation of the drain pump 59 in a case where the drain pump 59 is operating. When the second condition is satisfied and the drain pump 59 is operating, the indoor control unit 92 continues the operation of the drain pump 59 or stops the operation of the drain pump 59 on the basis of predetermined conditions to be described below.

The evaporation temperature of the refrigerant in the indoor heat exchanger 50 at the time of executing the cooling operation is detected by an evaporation temperature thermistor 51. As illustrated in FIG. 1, the evaporation temperature thermistor 51 is attached to the indoor heat exchanger 50. The indoor control unit 92 acquires the evaporation temperature of the refrigerant in the indoor heat exchanger 50 from the evaporation temperature thermistor 51.

The dew point temperature of the indoor air is calculated from data detected by an indoor temperature sensor 52 and an indoor humidity sensor 53. As illustrated in FIG. 1, the indoor temperature sensor 52 and the indoor humidity sensor 53 are attached to the indoor unit 12. The indoor temperature sensor 52 and the indoor humidity sensor 53 are attached near the suction port 36 of the indoor unit 12. The indoor control unit 92 acquires a temperature of the indoor air sucked into the indoor unit 12 from the indoor temperature sensor 52. The indoor control unit 92 acquires relative humidity of the indoor air sucked into the indoor unit 12 from the indoor humidity sensor 53. The indoor control unit 92 calculates the dew point temperature of the indoor air from the temperature and the relative humidity of the indoor air.

Figure 6:
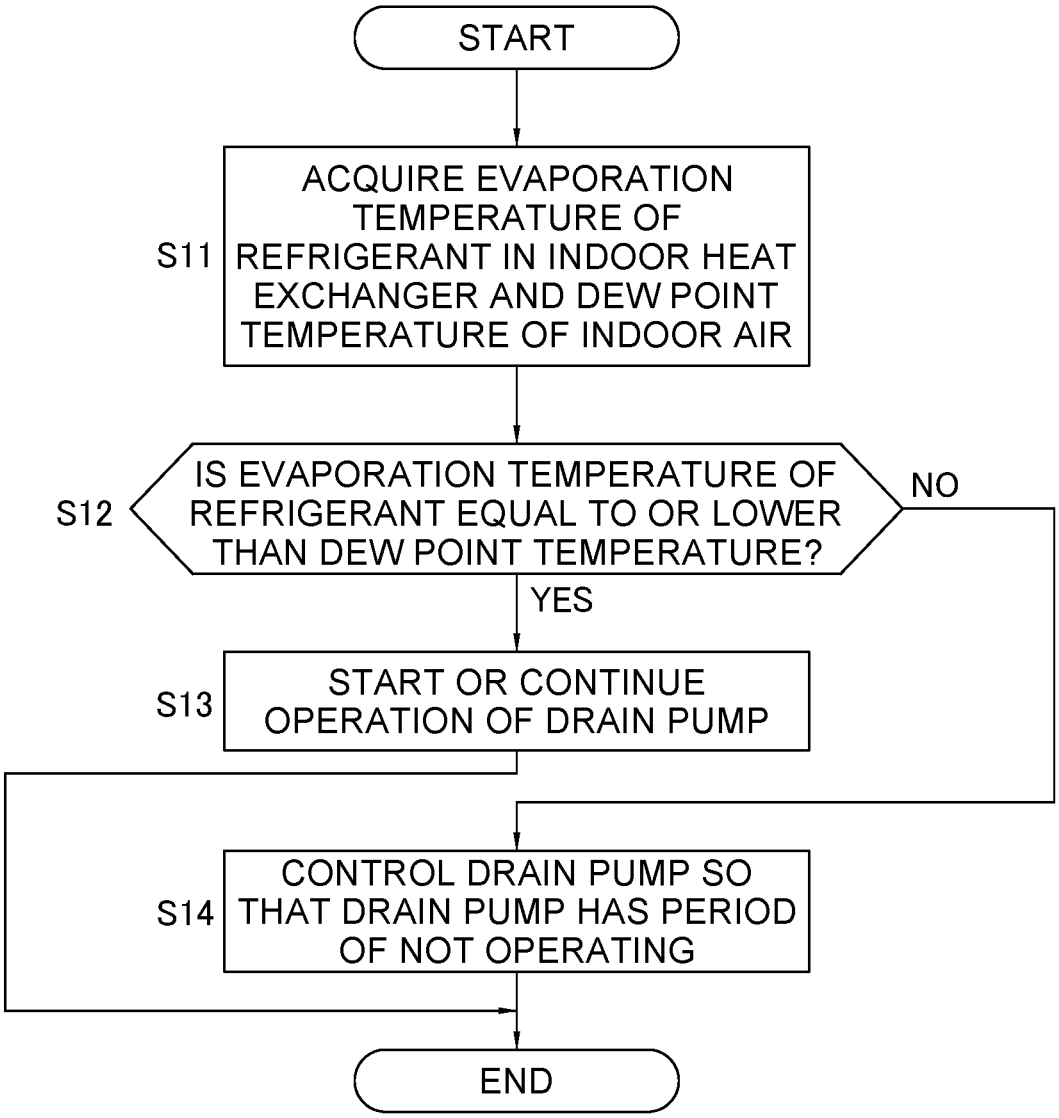
FIG. 6 is a flowchart illustrating control of the drain pump 59 according to a first embodiment.

Next, the control (first control) of the drain pump 59 by means of the indoor control unit 92 at the time of executing the cooling operation of the air conditioner 10 will be described with reference to a flowchart of FIG. 6. The indoor control unit 92 executes processing illustrated in FIG. 6 at predetermined time intervals.

The indoor control unit 92 acquires the evaporation temperature of the refrigerant in the indoor heat exchanger 50 and the dew point temperature of the indoor air (step S11). The indoor control unit 92 acquires a detection value of the evaporation temperature of the refrigerant from the evaporation temperature thermistor 51. The indoor control unit 92 acquires detection values of the temperature and the relative humidity of the indoor air from the indoor temperature sensor 52 and the indoor humidity sensor 53, and calculates and acquires the dew point temperature of the indoor air.

Subsequently, the indoor control unit 92 determines whether or not the evaporation temperature of the refrigerant is equal to or lower than the dew point temperature of the indoor air (step S12). In a case of determining that the evaporation temperature of the refrigerant is equal to or lower than the dew point temperature of the indoor air, the indoor control unit 92 performs control of starting or continuing the operation of the drain pump 59 (step S13). Specifically, in a case where the drain pump 59 is operating, the indoor control unit 92 continues the operation of the drain pump 59 without stopping the operation. In a case where the drain pump 59 is stopped, the indoor control unit 92 starts the operation of the drain pump 59. For example, the indoor control unit 92 immediately starts the operation of the drain pump 59 in a case of determining that the evaporation temperature of the refrigerant is equal to or lower than the dew point temperature of the indoor air at the time of starting the air conditioner 10.

In a case of determining that the evaporation temperature of the refrigerant is higher than the dew point temperature of the indoor air in step S12, the indoor control unit 92 controls the drain pump 59 so that the drain pump 59 has a period of not operating (step S14). Next, two specific examples of determination criteria that are conditions relating to whether the indoor control unit 92 continues the operation of the drain pump 59 or stops the operation of the drain pump 59 in a case where the drain pump 59 is operating in step S14 will be described.

Figure 7:
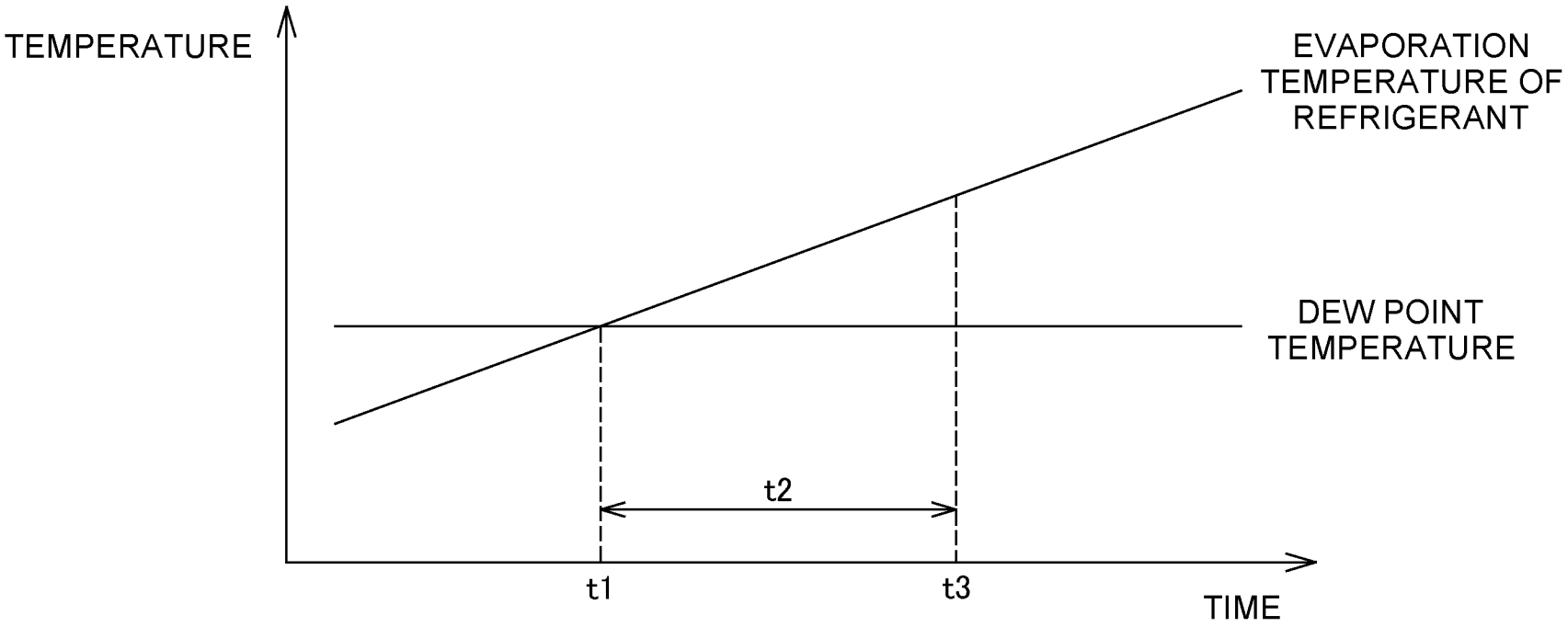
FIG. 7 is a time chart for explaining a first determination criterion in step S14 of FIG. 6.

In a first determination criterion, as illustrated in FIG. 7, the indoor control unit 92 continues the operation of the drain pump 59 for a predetermined period t2 from a time point t1 of transition from a state in which the evaporation temperature of the refrigerant is equal to or lower than the dew point temperature to a state in which the evaporation temperature of the refrigerant is higher than the dew point temperature. Thereafter, the indoor control unit 92 stops the operation of the drain pump 59 at a time point t3 when the predetermined period t2 has elapsed from the time point t1. The predetermined period t2 is, for example, one to five minutes.

In a second determination criterion, the indoor control unit 92 continues the operation of the drain pump 59 in a case of detecting an abnormality in at least one of the evaporation temperature thermistor 51, the indoor temperature sensor 52, and the indoor humidity sensor 53. The indoor control unit 92 detects the abnormality by receiving a signal related to occurrence of the abnormality from the evaporation temperature thermistor 51, the indoor temperature sensor 52, and the indoor humidity sensor 53.

The indoor control unit 92 controls the drain pump 59 on the basis of at least one of the first determination criterion and the second determination criterion. In a case where both the first determination criterion and the second determination criterion are applied, the indoor control unit 92 continues the operation of the drain pump 59 even in a case where the operation of the drain pump 59 can be stopped on the basis of the first determination criterion. In other words, the second determination criterion is applied in preference to the first determination criterion.

(5) Characteristics (5-1)

The indoor control unit 92 of the indoor unit 12 changes a method of controlling the drain pump 59 on the basis of the evaporation temperature of the refrigerant in the indoor heat exchanger 50 and the dew point temperature of the indoor air at the time of executing the cooling operation of the air conditioner 10. Specifically, in a case where the evaporation temperature of the refrigerant is higher than the dew point temperature and the speed at which the water level of the drain water in the drain pan 57 rises is low, the indoor control unit 92 continues the operation of the drain pump 59 or stops the operation of the drain pump 59 on the basis of the predetermined conditions. As a result, power consumption of the drain pump 59 is suppressed as compared with a case where the drain pump 59 is constantly operated.

(5-2)

On the basis of the first determination criterion, the indoor control unit 92 of the indoor unit 12 stops the operation of the drain pump 59 after the predetermined period has elapsed from the time point of transition from the state in which the evaporation temperature of the refrigerant is equal to or lower than the dew point temperature to the state in which the evaporation temperature of the refrigerant is higher than the dew point temperature. At the time point of transition to the state in which the evaporation temperature of the refrigerant is higher than the dew point temperature, the speed at which the water level of the drain water in the drain pan 57 rises may be high as the drain water continues to accumulate in the drain pan 57. Therefore, in a case where the operation of drain pump 59 is stopped at the time point of transition to the state in which the evaporation temperature of the refrigerant is higher than the dew point temperature, the drain water may overflow the drain pan 57 and leak.

Therefore, by controlling the drain pump 59 on the basis of the first determination criterion, it is possible to suppress the drain water from overflowing the drain pan 57 and leaking.

(5-3)

On the basis of the second determination criterion, the indoor control unit 92 of the indoor unit 12 continues the operation of the drain pump 59 in a case of detecting the abnormality in at least one of the evaporation temperature thermistor 51, the indoor temperature sensor 52, and the indoor humidity sensor 53. In a case where the abnormality occurs in at least one of the evaporation temperature thermistor 51, the indoor temperature sensor 52, and the indoor humidity sensor 53, the indoor control unit 92 cannot normally acquire at least one of the evaporation temperature of the refrigerant and the dew point temperature. In this case, the indoor control unit 92 may erroneously determine that the evaporation temperature of the refrigerant is higher than the dew point temperature although the evaporation temperature of the refrigerant is actually equal to or lower than the dew point temperature. In a case where the indoor control unit 92 stops the operation of the drain pump 59 in this state, the drain water may overflow the drain pan 57 and leak.

Therefore, by continuing the operation of the drain pump 59 on the basis of the second determination criterion, it is possible to suppress the drain water from overflowing the drain pan 57 and leaking.

(5-4)

The indoor control unit 92 of the indoor unit 12 determines whether or not the dew condensation water is likely to be generated on the surface of the indoor heat exchanger 50 on the basis of the evaporation temperature of the refrigerant in the indoor heat exchanger 50 and the dew point temperature of the indoor air. The evaporation temperature of the refrigerant is detected by the evaporation temperature thermistor 51, and the dew point temperature of the indoor air is detected by the indoor temperature sensor 52 and the indoor humidity sensor 53. The evaporation temperature thermistor 51, the indoor temperature sensor 52, and the indoor humidity sensor 53 are sensors used in a conventional air conditioner 10 as well. Therefore, it is not necessary to use a special sensor for determining whether or not the dew condensation water is likely to be generated on the surface of the indoor heat exchanger 50, so that the cost of the indoor unit 12 is suppressed.

(5-5)

Since the power consumption of the drain pump 59 is suppressed, power necessary for the operation of the air conditioner 10 is suppressed.

Second Embodiment

The air conditioner 10 including the indoor unit 12 according to a second embodiment of the present disclosure has the same configuration and operation as those of the first embodiment. Hereinbelow, control of the indoor unit 12 at the time of executing the cooling operation, which is a difference from the first embodiment, will be described.

(1) Control of Indoor Unit 12

The indoor control unit 92 controls the drain pump 59 such that an operation start condition of the drain pump 59 in a first state and an operation start condition of the drain pump 59 in a second state are different from each other at the time of executing the cooling operation of the air conditioner 10. The operation start condition of the drain pump 59 is a condition related to the time to start the operation of the drain pump 59 after starting the air conditioner 10.

The first state and the second state represent states of the air conditioner 10 after starting the air conditioner 10. The second state is a state in which a load on the air conditioner 10 at the time of executing the cooling operation is smaller than that in the first state. In general, the higher the numbers of rotations of the compressor 20, the outdoor fan 35, and the indoor fan 55, or the larger a difference between the temperature of the indoor air and a temperature of the outdoor air, the larger the load on the air conditioner 10.

Examples of definitions of the first state and the second state in the present embodiment will be described. The first state is a state in which the evaporation temperature of the refrigerant in the indoor heat exchanger 50 is equal to or lower than the dew point temperature of the indoor air. The second state is a state in which the evaporation temperature of the refrigerant in the indoor heat exchanger 50 is higher than the dew point temperature of the indoor air. In a case where the evaporation temperature of the refrigerant is higher than the dew point temperature, water vapor contained in the indoor air is hardly condensed on a surface of the indoor heat exchanger 50. On the other hand, in a case where the evaporation temperature of the refrigerant is equal to or lower than the dew point temperature, the water vapor contained in the indoor air is easily condensed on the surface of the indoor heat exchanger 50. Therefore, the second state is a state in which the amount of dew condensation water generated on the surface of the indoor heat exchanger 50 is smaller than that in the first state. Therefore, the second state is a state in which a speed at which the water level of the drain water in the drain pan 57 rises is lower than that in the first state. The definitions of the first state and the second state are not limited to the above definitions.

The evaporation temperature of the refrigerant in the indoor heat exchanger 50 at the time of executing the cooling operation is detected by an evaporation temperature thermistor 51. As illustrated in FIG. 1, the evaporation temperature thermistor 51 is attached to the indoor heat exchanger 50. The indoor control unit 92 acquires the evaporation temperature of the refrigerant in the indoor heat exchanger 50 from the evaporation temperature thermistor 51.

The dew point temperature of the indoor air is calculated from data detected by an indoor temperature sensor 52 and an indoor humidity sensor 53. As illustrated in FIG. 1, the indoor temperature sensor 52 and the indoor humidity sensor 53 are attached to the indoor unit 12. The indoor temperature sensor 52 and the indoor humidity sensor 53 are attached near the suction port 36 of the indoor unit 12. The indoor control unit 92 acquires a temperature of the indoor air sucked into the indoor unit 12 from the indoor temperature sensor 52. The indoor control unit 92 acquires relative humidity of the indoor air sucked into the indoor unit 12 from the indoor humidity sensor 53. The indoor control unit 92 calculates the dew point temperature of the indoor air from the temperature and the relative humidity of the indoor air.

Figure 9:
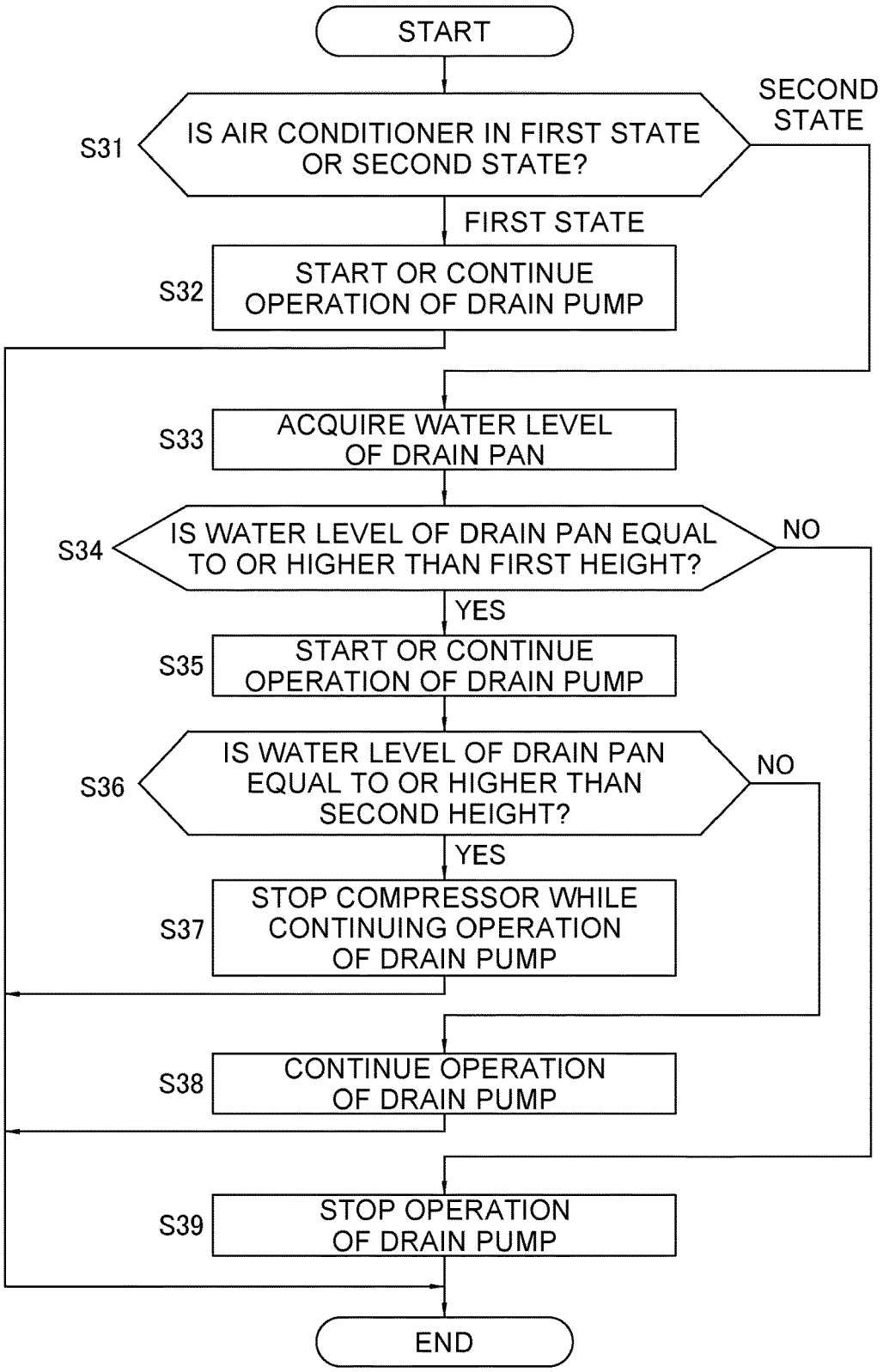
FIG. 9 is a flowchart illustrating control of the drain pump 59 according to a second embodiment.

Next, control of the drain pump 59 by means of the indoor control unit 92 at the time of executing the cooling operation of the air conditioner 10 will be described with reference to a flowchart of FIG. 9. The indoor control unit 92 executes processing illustrated in FIG. 9 at predetermined time intervals.

The indoor control unit 92 determines whether the state of the air conditioner 10 is the first state or the second state (step S31). For example, consider a case where the first state and the second state are defined as described above. In a case where the evaporation temperature of the refrigerant in the indoor heat exchanger 50 is higher than the dew point temperature of the indoor air, the indoor control unit 92 determines that the air conditioner 10 is in the second state. In a case where the evaporation temperature of the refrigerant in the indoor heat exchanger 50 is equal to or lower than the dew point temperature of the indoor air, the indoor control unit 92 determines that the air conditioner 10 is in the first state. Alternatively, the indoor control unit 92 may determine the state of the air conditioner 10 by another method.

In a case of determining that the air conditioner 10 is in the first state, the indoor control unit 92 performs control of starting or continuing the operation of the drain pump 59 (step S32). Specifically, in a case of determining that the air conditioner 10 is in the first state in a state where the drain pump 59 is operating, the indoor control unit 92 continues the operation of the drain pump 59 without stopping the operation. Also, in a case of determining that the air conditioner 10 is in the first state in a state where the drain pump 59 is stopped, the indoor control unit 92 starts the operation of the drain pump 59. For example, in a case of determining that the air conditioner 10 is in the first state at the time of starting the air conditioner 10, the indoor control unit 92 immediately starts the operation of the drain pump 59.

In a case of determining that the air conditioner 10 is in the second state, the indoor control unit 92 controls the operation of the drain pump 59 according to the change in the water level of the drain water in the drain pan 57. The indoor control unit 92 starts the operation of the drain pump 59 when the water level of the drain pan 57 rises to reach a first height h1, and stops the operation of the drain pump 59 when the water level of the drain pan 57 falls below the first height h1. As illustrated in FIG. 5, the first height h1 is set to a position higher than a third height h3, which is a height position of the water suction port 59*a* of the drain pump 59, and lower than a second height h2. The second height h2 is a predetermined height position higher than the first height h1 and lower than the maximum water level h0. The water level of the drain pan 57 illustrated in FIG. 5 is the first height h1.

Therefore, in a case of determining that the air conditioner 10 is in the second state at the time of starting the air conditioner 10, and in a case where the water level of the drain pan 57 is lower than the first height h1, the indoor control unit 92 does not start the operation of the drain pump 59. In this case, when, after starting the air conditioner 10, the water level of the drain pan 57 rises to reach the first height h1, the indoor control unit 92 starts the operation of the drain pump 59. Thereafter, when the water level of the drain pan 57 falls below the first height h1, the indoor control unit 92 stops the operation of the drain pump 59.

Regardless of the state of the air conditioner 10 (the first state or the second state), when the water level of the drain pan 57 reaches the second height h2, the indoor control unit 92 stops the compressor 20 while continuing the operation of the drain pump 59 in order to suppress the drain water from overflowing the drain pan 57 and leaking. The indoor control unit 92 transmits a control signal for stopping the compressor 20 to the outdoor control unit 91. In this case, for example, after continuing the operation of the drain pump 59 until the water level of the drain pan 57 drops to a predetermined height (for example, the first height h1) lower than the second height h2, the indoor control unit 92 may transmit a control signal for starting the operation of the compressor 20 to the outdoor control unit 91.

Next, specific processing in a case where it is determined in step S31 that the air conditioner 10 is in the second state will be described. First, the indoor control unit 92 acquires the water level of the drain pan 57 from the water level sensor 58 (step S33). Subsequently, the indoor control unit 92 determines whether or not the water level of the drain pan 57 is equal to or higher than the first height h1 (step S34). In a case where the water level of the drain pan 57 is equal to or higher than the first height h1, the indoor control unit 92 starts the operation of the drain pump 59 in a case where the operation of the drain pump 59 is stopped, and continues the operation of the drain pump 59 in a case where the drain pump 59 is operating (step S35). Subsequently, the indoor control unit 92 determines whether or not the water level of the drain pan 57 is equal to or higher than the second height h2 (step S36). In a case where the water level of the drain pan 57 is equal to or higher than the second height h2, the indoor control unit 92 stops the compressor 20 while continuing the operation of the drain pump 59 (step S37). In a case where the water level of the drain pan 57 is less than the second height h2, the indoor control unit 92 continues the operation of the drain pump 59 without stopping the compressor 20 (step S38).

In a case where the water level of the drain pan 57 is less than the first height h1 in step S34, the indoor control unit 92 keeps the operation of the drain pump 59 stopped in a case where the operation of the drain pump 59 is stopped, and stops the operation of the drain pump 59 in a case where the drain pump 59 is operating (step S39).

(2) Characteristics (2-1)

The indoor control unit 92 of the indoor unit 12 changes a method of controlling the drain pump 59 according to the load on the air conditioner 10 at the time of executing the cooling operation of the air conditioner 10. For example, in a case where the load on the air conditioner 10 is small and the speed at which the water level of the drain water in the drain pan 57 rises is low, the indoor control unit 92 does not start the operation of the drain pump 59 until the water level of the drain pan 57 reaches a predetermined height. As a result, power consumption of the drain pump 59 is suppressed as compared with a case where the drain pump 59 is constantly operated.

(2-2)

In a case where the load on the air conditioner 10 is large and the speed at which the water level of the drain water in the drain pan 57 rises is high, the indoor control unit 92 of the indoor unit 12 constantly operates the drain pump 59. As a result, leakage of the drain water due to a rapid rise in the water level of the drain pan 57 is suppressed.

On the other hand, in a case where the load on the air conditioner 10 is small and the speed at which the water level of the drain water in the drain pan 57 rises is low, the indoor control unit 92 of the indoor unit 12 stops the operation of the drain pump 59 when the water level of the drain pan 57 falls below the first height h1. As a result, power consumption of the drain pump 59 is suppressed as compared with a case where the drain pump 59 is constantly operated.

(2-3)

In a case where the speed at which the water level of the drain water in the drain pan 57 rises is low, the indoor control unit 92 of the indoor unit 12 starts the operation of the drain pump 59 when the water level of the drain pan 57 reaches the first height h1, which is higher than the third height h3, which is the height position of the water suction port 59*a* of the drain pump 59. In other words, the indoor control unit 92 does not start the operation of the drain pump 59 immediately after the water level of the drain pan 57 reaches the third height h3. In this manner, by setting the first height h1 so as to be higher than the third height h3 and delaying the time when the operation of the drain pump 59 starts, the power consumption of the drain pump 59 is suppressed.

Also, when the water level of the drain pan 57 falls below the first height h1, the indoor control unit 92 of the indoor unit 12 stops the operation of the drain pump 59. In other words, the indoor control unit 92 does not continue the operation of the drain pump 59 until the water level of the drain pan 57 is lowered to the third height h3, and stops the operation of the drain pump 59 at a time point when the water level is lowered to the first height h1, which is higher than the third height h3. In this manner, the first height h1 is set so as to be higher than the third height h3, and the time to stop the operation of the drain pump 59 is advanced, whereby the power consumption of the drain pump 59 is suppressed.

(2-4)

In a case where the first state and the second state are defined as described above, the indoor control unit 92 of the indoor unit 12 determines whether or not the dew condensation water is likely to be generated on the surface of the indoor heat exchanger 50 on the basis of the evaporation temperature of the refrigerant in the indoor heat exchanger 50 and the dew point temperature of the indoor air, and estimates the load on the air conditioner 10. The evaporation temperature of the refrigerant is detected by the evaporation temperature thermistor 51, and the dew point temperature of the indoor air is detected by the indoor temperature sensor 52 and the indoor humidity sensor 53. The evaporation temperature thermistor 51, the indoor temperature sensor 52, and the indoor humidity sensor 53 are sensors used in a conventional air conditioner 10 as well. Therefore, it is not necessary to use a special sensor for estimating the load on the air conditioner 10, so that the cost of the indoor unit 12 is suppressed.

(2-5)

Since the power consumption of the drain pump 59 is suppressed, power necessary for the operation of the air conditioner 10 is suppressed.

Third Embodiment

The air conditioner 10 including the indoor unit 12 according to a third embodiment of the present disclosure has the same configuration and operation as those of the second embodiment. Hereinbelow, control of the indoor unit 12 at the time of executing the cooling operation, which is a difference from the second embodiment, will be described.

(1) Control of Indoor Unit 12

In the second embodiment, the indoor control unit 92 changes the method of controlling the drain pump 59 according to the load of the air conditioner 10. In the present embodiment, the indoor control unit 92 controls the operation of the drain pump 59 according to the change in the water level of the drain water in the drain pan 57 regardless of a level of the load on the air conditioner 10.

Specifically, the indoor control unit 92 starts the operation of the drain pump 59 when the water level of the drain pan 57 rises to reach the first height h1, and stops the operation of the drain pump 59 when the water level of the drain pan 57 falls below the first height h1. The first height h1 is set to a position higher than the third height h3, which is a height position of the water suction port 59*a* of the drain pump 59, and lower than the second height h2. When the water level of the drain pan 57 reaches the second height h2, the indoor control unit 92 stops the compressor 20 while continuing the operation of the drain pump 59. In the present embodiment, the indoor control unit 92 starts the control from processing in step S33 without performing processing in steps S31 and S32 of FIG. 9.

(2) Characteristics

At the time of executing the cooling operation of the air conditioner 10, the indoor control unit 92 of the indoor unit 12 starts the operation of the drain pump 59 when the water level of the drain pan 57 reaches the first height h1, which is higher than the third height h3, which is the height position of the water suction port 59*a* of the drain pump 59. In other words, the indoor control unit 92 does not start the operation of the drain pump 59 immediately after the water level of the drain pan 57 reaches the third height h3. In this manner, by setting the first height h1 so as to be higher than the third height h3 and delaying the time when the operation of the drain pump 59 starts, the power consumption of the drain pump 59 is suppressed.

Also, when the water level of the drain pan 57 falls below the first height h1, the indoor control unit 92 of the indoor unit 12 stops the operation of the drain pump 59. In other words, the indoor control unit 92 does not continue the operation of the drain pump 59 until the water level of the drain pan 57 is lowered to the third height h3, and stops the operation of the drain pump 59 at a time point when the water level is lowered to the first height h1, which is higher than the third height h3. In this manner, the first height h1 is set so as to be higher than the third height h3, and the time to stop the operation of the drain pump 59 is advanced, whereby the power consumption of the drain pump 59 is suppressed.

MODIFICATION EXAMPLES

(1) Modification Example A

In the first embodiment, the indoor control unit 92 determines that the second condition is satisfied in a case where the evaporation temperature of the refrigerant in the indoor heat exchanger 50 is higher than the dew point temperature of the indoor air.

Alternatively, the indoor control unit 92 may determine that the second condition is satisfied in a case where a difference between the evaporation temperature of the refrigerant and the dew point temperature of the indoor air is smaller than a predetermined value when the evaporation temperature of the refrigerant is equal to or lower than the dew point temperature of the indoor air. In other words, for example, the indoor control unit 92 may determine that the second condition is satisfied even in a case where the evaporation temperature of the refrigerant is slightly lower than the dew point temperature of the indoor air. In this case, the indoor control unit 92 determines that the second condition is satisfied in a case where an evaporation temperature Tc of the refrigerant and a dew point temperature Td of the indoor air satisfy a relational expression $Td-c<Tc$. A constant c is the predetermined value described above, and is, for example, 1° C. or 2° C. In a state where the evaporation temperature of the refrigerant is slightly lower than the dew point temperature of the indoor air, the amount of dew condensation water generated on the surface of the indoor heat exchanger 50 may be small as in a case where the evaporation temperature of the refrigerant is higher than the dew point temperature of the indoor air.

Therefore, by controlling the indoor unit 12 by defining the second condition as described above, the operation time of the drain pump 59 is shortened, so that the power consumption of the drain pump 59 is suppressed.

In the present modification example, with respect to the first determination criterion, the indoor control unit 92 may continue the operation of the drain pump 59 for a predetermined period from a time point of transition from a state in which the evaporation temperature Tc of the refrigerant is equal to or lower than a temperature Td−c slightly lower than the dew point temperature of the indoor air to a state in which the evaporation temperature Tc of the refrigerant is higher than the temperature Td−c. Thereafter, the indoor control unit 92 stops the operation of the drain pump 59 at a time point when the predetermined period has elapsed.

(2) Modification Example B

For example, the indoor control unit 92 of the first embodiment may determine whether or not to perform the first control depending on the load on the air conditioner at the time of executing the cooling operation. For example, the indoor control unit 92 may start or continue the operation of the drain pump without performing the first control in the first state, and perform the first control in the second state.

The first state and the second state represent states of the air conditioner 10 after starting the air conditioner 10. The second state is a state in which a load on the air conditioner 10 at the time of executing the cooling operation is smaller than that in the first state. In general, the higher the numbers of rotations of the compressor 20, the outdoor fan 35, and the indoor fan 55, or the larger a difference between the temperature of the indoor air and a temperature of the outdoor air, the larger the load on the air conditioner 10.

The indoor control unit 92 continues the operation of the drain pump 59 when the air conditioner 10 is in the first state. The indoor control unit 92 performs the first control of the first embodiment when the air conditioner 10 is in the second state.

Figure 8:
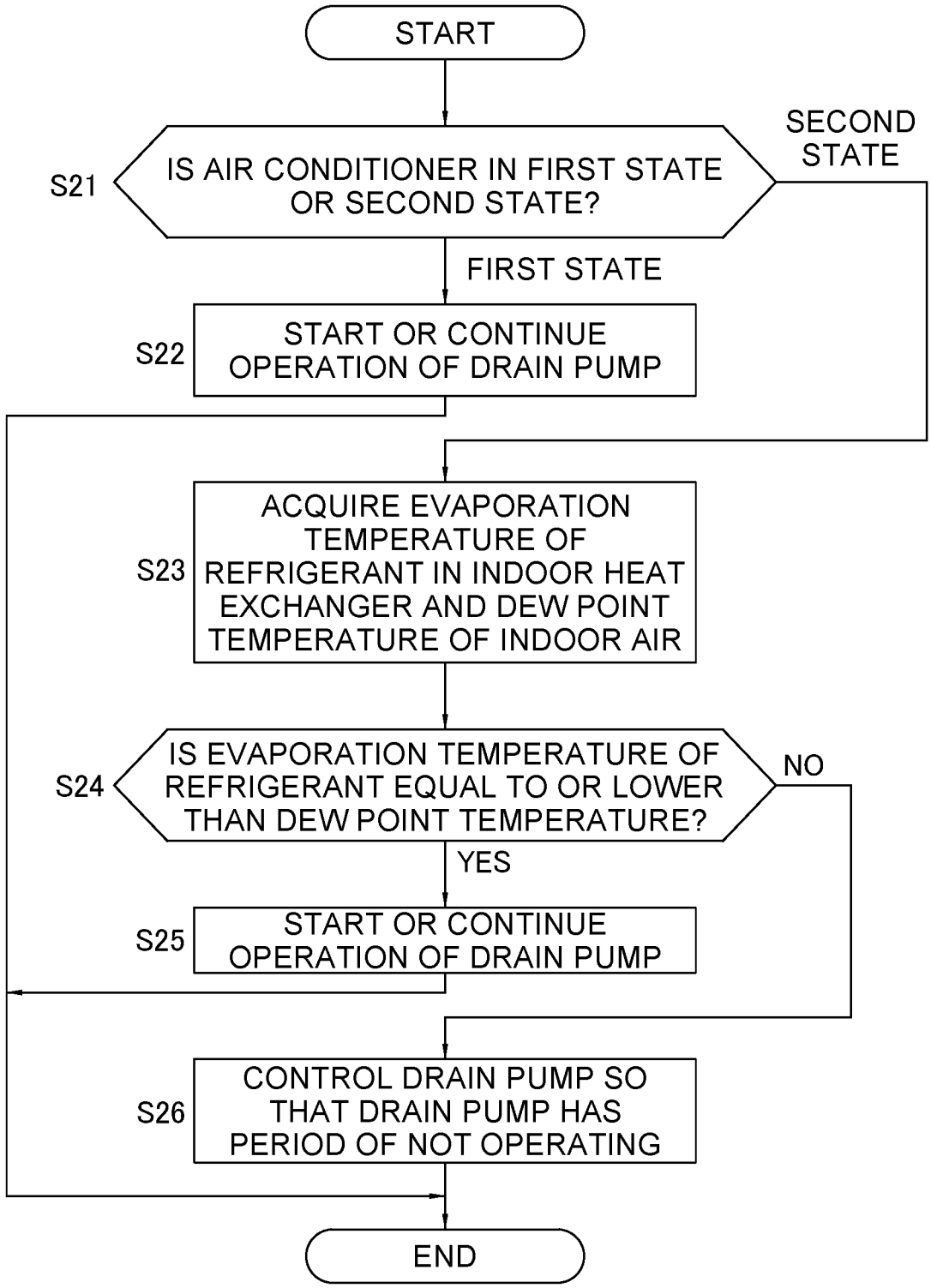
FIG. 8 is a flowchart illustrating control of the drain pump 59 according to Modification Example B.

Next, control of the drain pump 59 by means of the indoor control unit 92 at the time of executing the cooling operation of the air conditioner 10 will be described with reference to a flowchart of FIG. 8. The indoor control unit 92 executes processing illustrated in FIG. 8 at predetermined time intervals.

The indoor control unit 92 determines whether the state of the air conditioner 10 is the first state or the second state (step S21). The indoor control unit 92 determines the state of the air conditioner 10 on the basis of parameters such as the numbers of rotations of the compressor 20, the outdoor fan 35, and the indoor fan 55 and the difference between the temperature of the indoor air and the temperature of the outdoor air.

In a case of determining that the air conditioner 10 is in the first state, the indoor control unit 92 performs control of starting or continuing the operation of the drain pump 59 (step S22). Specifically, in a case of determining that the air conditioner 10 is in the first state in a state where the drain pump 59 is operating, the indoor control unit 92 continues the operation of the drain pump 59 without stopping the operation. Also, in a case of determining that the air conditioner 10 is in the first state in a state where the drain pump 59 is stopped, the indoor control unit 92 starts the operation of the drain pump 59. For example, in a case of determining that the air conditioner 10 is in the first state at the time of starting the air conditioner 10, the indoor control unit 92 immediately starts the operation of the drain pump 59.

In a case of determining in step S21 that the air conditioner 10 is in the second state, the indoor control unit 92 performs the same processing as steps S11 to S14 of the first embodiment (steps S23 to S26) as described below.

The indoor control unit 92 acquires the evaporation temperature of the refrigerant in the indoor heat exchanger 50 and the dew point temperature of the indoor air (step S23). The indoor control unit 92 acquires a detection value of the evaporation temperature of the refrigerant from the evaporation temperature thermistor 51. The indoor control unit 92 acquires detection values of the temperature and the relative humidity of the indoor air from the indoor temperature sensor 52 and the indoor humidity sensor 53, and calculates the dew point temperature of the indoor air.

Subsequently, the indoor control unit 92 determines whether or not the evaporation temperature of the refrigerant is equal to or lower than the dew point temperature of the indoor air (step S24). In a case of determining that the evaporation temperature of the refrigerant is equal to or lower than the dew point temperature of the indoor air, the indoor control unit 92 performs control of starting or continuing the operation of the drain pump 59 (step S25). Specifically, in a case where the drain pump 59 is operating, the indoor control unit 92 continues the operation of the drain pump 59 without stopping the operation. In a case where the drain pump 59 is stopped, the indoor control unit 92 starts the operation of the drain pump 59. For example, the indoor control unit 92 immediately starts the operation of the drain pump 59 in a case of determining that the evaporation temperature of the refrigerant is equal to or lower than the dew point temperature of the indoor air at the time of starting the air conditioner 10.

In a case of determining that the evaporation temperature of the refrigerant is higher than the dew point temperature of the indoor air in step S24, the indoor control unit 92 controls the drain pump 59 so that the drain pump 59 has a period of not operating (step S26).

In the present modification, the indoor control unit 92 of the indoor unit 12 constantly operates the drain pump 59 in a case where the load on the air conditioner 10 is large at the time of executing the cooling operation of the air conditioner 10. In the first state, in which the load on the air conditioner 10 is large, the speed at which the water level of the drain water in the drain pan 57 rises is high. Therefore, leakage of the drain water due to the rapid rise in the water level of the drain pan 57 is suppressed.

On the other hand, in a case where the load on the air conditioner 10 is small at the time of executing the cooling operation of the air conditioner 10, the indoor control unit 92 of the indoor unit 12 changes the method of controlling the drain pump 59 on the basis of the evaporation temperature of the refrigerant in the indoor heat exchanger 50 and the dew point temperature of the indoor air. In the second state, in which the load on the air conditioner 10 is small, the speed at which the water level of the drain water in the drain pan 57 rises is low. In this case, the indoor control unit 92 continues the operation of the drain pump 59 or stops the operation of the drain pump 59 based on the predetermined conditions. As a result, power consumption of the drain pump 59 is suppressed as compared with a case where the drain pump 59 is constantly operated.

(3) Modification Example C

The indoor unit 12 according to the first embodiment is used in the air conditioner 10 having cooling and heating functions. Alternatively, the indoor unit 12 may be used in the air conditioner 10 dedicated to cooling.

(4) Modification Example D

In the second embodiment and the third embodiment, for example, the second state is defined as a state in which the evaporation temperature of the refrigerant in the indoor heat exchanger 50 is higher than the dew point temperature of the indoor air. In a case where the evaporation temperature of the refrigerant is higher than the dew point temperature of the indoor air, the indoor control unit 92 determines that the air conditioner 10 is in the second state.

However, for example, in a case where the evaporation temperature of the refrigerant is equal to or lower than the dew point temperature of the indoor air, a state in which the difference between the evaporation temperature of the refrigerant and the dew point temperature of the indoor air is smaller than the predetermined value may also be defined to fall within the second state. In other words, for example, a state in which the evaporation temperature of the refrigerant is slightly lower than the dew point temperature of the indoor air may also be defined as the second state. In this case, the indoor control unit 92 determines that the air conditioner 10 is in the second state in a case where the evaporation temperature Tc of the refrigerant and the dew point temperature Td of the indoor air satisfy the relational expression $Td-c<Tc$. A constant c is the predetermined value described above, and is, for example, 1° C. or 2° C. In a state where the evaporation temperature of the refrigerant is slightly lower than the dew point temperature of the indoor air, the amount of dew condensation water generated on the surface of the indoor heat exchanger 50 may be small as in a case where the evaporation temperature of the refrigerant is higher than the dew point temperature of the indoor air.

Therefore, by controlling the indoor unit 12 by defining the second state of the air conditioner 10 as described above, the operation time of the drain pump 59 is shortened, so that the power consumption of the drain pump 59 is suppressed.

(5) Modification Example E

In the second embodiment and the third embodiment, the first height h1 is set to the position higher than the height h3 of the water suction port 59*a* of the drain pump 59 and lower than the second height h2. For example, the first height h1 may further be set to a position lower than an intermediate height position (h2+h3)/2 between the height h3 of the water suction port 59*a* of the drain pump 59 and the second height h2. In this case, the water level of the drain pan 57, which is a condition for starting the operation of the drain pump 59, is set near the water suction port 59*a* of the drain pump 59. As a result, leakage of the drain water due to a rapid rise in the water level of the drain pan 57 is suppressed.

(6) Modification Example F

The indoor unit 12 according to the second and third embodiments is used in the air conditioner 10 having cooling and heating functions. Alternatively, the indoor unit 12 may be used in the air conditioner 10 dedicated to cooling.

The embodiment of the present disclosure has been described above. Various modifications to modes and details should be available without departing from the object and the scope of the present disclosure recited in the claims.

REFERENCE SIGNS LIST

10: air conditioner
12: indoor unit
20: compressor
50: indoor heat exchanger (heat exchanger)
51: evaporation temperature thermistor (first sensor)

52: indoor temperature sensor (second sensor)
53: indoor humidity sensor (second sensor)
57: drain pan
59: drain pump
59*a*: water suction port of drain pump
92: indoor control unit (control unit)

CITATION LIST

Patent Literature

Patent Literature 1: JP H07-332743 A

The invention claimed is:

1. An indoor unit used in an air conditioner capable of executing a cooling operation by circulating a refrigerant, the indoor unit comprising:

a heat exchanger that exchanges heat between the refrigerant and indoor air;

a drain pan that receives water generated in the heat exchanger;

a drain pump that sucks up the water from the drain pan; and a controller, wherein at a time of executing the cooling operation, the controller controls the drain pump such that an operation start condition of the drain pump in a first state and an operation start condition of the drain pump in a second state are different from each other, and the second state is a state in which a load on the air conditioner at the time of executing the cooling operation is smaller than that in the first state; and wherein, at the time of executing the cooling operation, the controller continues operation of the drain pump in the first state, and, in the second state, starts the operation of the drain pump in response to a water level of the drain pan rising to reach a predetermined height, and stops the operation of the drain pump in response to the water level of the drain pan falling below the predetermined height.

2. The indoor unit according to claim 1, wherein the predetermined height is higher than a height of a water suction port of the drain pump.

3. The indoor unit according to claim 1, wherein the second state includes a state in which an evaporation temperature of the refrigerant in the heat exchanger is higher than a dew point temperature of the indoor air, or a state in which a difference between the evaporation temperature and the dew point temperature is smaller than a predetermined value in a case where the evaporation temperature is equal to or lower than the dew point temperature.

4. An air conditioner comprising the indoor unit according to claim 1.

5. The indoor unit according to claim 1, wherein the operation start condition of the drain pump in the first state is a first time to start operation of the drain pump after starting the air conditioner and the operation start condition of the drain pump in the second state is a second time to start operation of the drain pump after starting the air conditioner.

* * * * *